US009910392B2

(12) United States Patent
Morizono

(10) Patent No.: US 9,910,392 B2
(45) Date of Patent: Mar. 6, 2018

(54) ROTATION DETECTION MECHANISM, FIXING DEVICE PROVIDED WITH THE SAME, AND IMAGE FORMING APPARATUS

(71) Applicant: KYOCERA Document Solutions Inc., Osaka (JP)

(72) Inventor: Koki Morizono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/473,066

(22) Filed: Mar. 29, 2017

(65) Prior Publication Data

US 2017/0285541 A1 Oct. 5, 2017

(30) Foreign Application Priority Data

Apr. 5, 2016 (JP) ..... 2016-076008

(51) Int. Cl.
*G03G 15/20* (2006.01)

(52) U.S. Cl.
CPC ..... *G03G 15/2053* (2013.01); *G03G 15/2078* (2013.01); *G03G 2215/0132* (2013.01); *G03G 2215/2035* (2013.01)

(58) Field of Classification Search
CPC ..... G03G 15/2032; G03G 15/2053; G03G 15/2067; G03G 15/2078; G03G 2215/0132; G03G 2215/2035
See application file for complete search history.

(56) References Cited

U.S. PATENT DOCUMENTS

| | | | | |
|---|---|---|---|---|
| 9,678,462 | B2 * | 6/2017 | Kitagawa | G03G 15/2067 |
| 2011/0229161 | A1 * | 9/2011 | Ueno | G03G 15/205 399/33 |
| 2013/0064584 | A1 | 3/2013 | Yonemoto | 399/328 |

FOREIGN PATENT DOCUMENTS

| | | |
|---|---|---|
| JP | 2012-154993 A | 8/2012 |
| JP | 2013-57774 A | 3/2013 |

* cited by examiner

*Primary Examiner* — Hoang Ngo
(74) *Attorney, Agent, or Firm* — Stein IP, LLC

(57) ABSTRACT

A rotation detection mechanism has a pulse plate, an optical sensor, a holder, and an input gear. The pulse plate has a light-blocking portion formed on an outer peripheral surface thereof. The optical sensor has a detection portion that detects whether an optical path thereof is opened or interrupted by the light-blocking portion of the pulse plate. The holder has a bearing hole that rotatably supports a rotary shaft of the pulse plate. The rotary shaft has a convex portion formed on an outer peripheral surface thereof and thus is in a key shape when seen from an axial direction thereof. On an inner peripheral surface of the bearing hole, a groove portion is formed through which the convex portion passes when the rotary shaft is inserted into the bearing hole, and the bearing hole is in a circular shape when seen from an axial direction thereof.

7 Claims, 6 Drawing Sheets

--Related Art--

ROTATION DETECTION MECHANISM, FIXING DEVICE PROVIDED WITH THE SAME, AND IMAGE FORMING APPARATUS

INCORPORATION BY REFERENCE

This application is based upon and claims the benefit of priority from the corresponding Japanese Patent Application No. 2016-76008 filed on Apr. 5, 2016, the entire contents of which are incorporated herein by reference.

BACKGROUND

The present disclosure relates to a rotation detection mechanism that detects rotation of a rotary body to be heated, such as a fixing roller or the like, and is used in a fixing device that is mounted in an image forming apparatus such as a copy machine, a printer, or the like and fixes an unfixed image.

In an electrophotographic image forming apparatus, a roller heating system has been widely used in which at least one roller (a fixing roller) of a roller pair forming a nip is heated, and a recording medium (a paper sheet) carrying an unfixed toner image is passed through the nip of the roller pair so that toner is fixed on the recording medium. Furthermore, a belt heating system has also been used in which, in place of a fixing roller, an endless fixing belt is used and caused to generate heat by a heating unit, and at a nip between the fixing belt and a pressing roller, an unfixed toner image is fixed on a recording medium via the fixing belt.

As a method for heating such a fixing roller, a fixing belt, or the like, there are known a lamp method in which heating is performed by using a lamp, such as a halogen lamp or the like, which is disposed on an inner side of the roller or the belt and an induction heating (IH) method in which, in response to requests for a reduction in warm-up time and energy saving, heating is performed by using an eddy current generated by interlinking an alternating magnetic field with a magnetic conductor.

By the way, in a case of heating the fixing roller (or the fixing belt), generally, in order to prevent temperature unevenness in a circumferential direction of the roller (or the belt) from occurring, the roller (or the belt) is heated while rotating.

Particularly in the IH method, an induction heating portion is provided with an excitation coil and a core and thus is increased in size, because of which, in many cases, the induction heating portion is disposed outside the fixing roller or the fixing belt, so that the roller or the belt is heated from outside. In this case, when the roller or the belt starts to be heated while not rotating, disadvantageously, only part of a surface of the roller or the belt is heated. Furthermore, even though a temperature detection sensor that detects a surface temperature of the roller or the belt is disposed, in a case where the induction heating portion and the temperature detection sensor are disposed at different positions from each other in the circumferential direction, an abnormal temperature rise cannot be detected, so that there is a fear that thermal deformation of the roller or the belt, smoke generation, or ignition might occur. For this reason, it is required that the induction heating portion be energized while the roller or the belt is being rotated.

For example, there is known a fixing device that, by using a rotation detection unit that is provided with an optical sensor (a photointerrupter sensor) and a pulse plate, detects whether or not a heating roller is rotating. In a method described above, in conjunction with driving a fixing roller or the heating roller to rotate, the pulse plate rotates to open or interrupt an optical path of a detection portion of the optical sensor, based on which whether or not the heating roller is rotating is detected.

SUMMARY

A rotation detection mechanism according to a first aspect of the present disclosure has a pulse plate, an optical sensor, a holder, and an input gear. The pulse plate has a light-blocking portion formed on an outer peripheral surface thereof. The optical sensor has a detection portion that detects whether an optical path thereof is opened or interrupted by the light-blocking portion of the pulse plate. The holder has a bearing hole that rotatably supports a rotary shaft of the pulse plate. The input gear inputs a rotational driving force to the rotary shaft. The rotary shaft has a convex portion formed on an outer peripheral surface thereof and thus is in a key shape when seen from an axial direction thereof. On an inner peripheral surface of the bearing hole, a groove portion is formed through which the convex portion passes when the rotary shaft is inserted into the bearing hole, and the bearing hole is in a circular shape when seen from an axial direction thereof.

Still other objects of the present disclosure and specific advantages provided by the present disclosure will be made further apparent from the following description of an embodiment.

DETAILED DESCRIPTION

Figure 1:
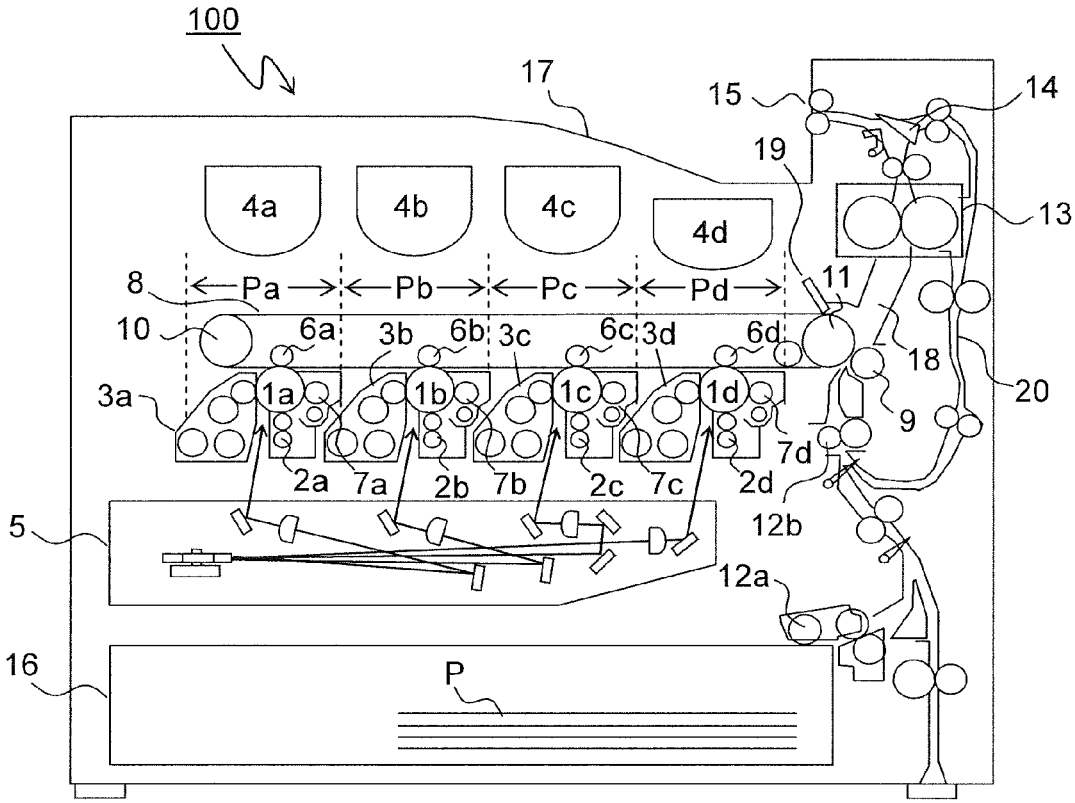
FIG. 1 is a schematic sectional view of a color printer in which a fixing device provided with a rotation detection mechanism of the present disclosure is mounted.

With reference to the appended drawings, the following describes an embodiment of the present disclosure. FIG. 1 is a schematic sectional view of an image forming apparatus in which a fixing device of the present disclosure is mounted, here showing a tandem type color printer. In a main body of a color printer 100, four image forming portions Pa, Pb, Pc, and Pd are arranged in order from an upstream side in a conveyance direction (a left side in FIG. 1). The image forming portions Pa to Pd are provided so as to correspond to images of four different colors (cyan, magenta, yellow, and black), respectively, and sequentially form images of cyan, magenta, yellow, and black, respectively, through processes of charging, exposure, development, and transfer.

In the image forming portions Pa to Pd, photosensitive drums 1*a*, 1 *b*, 1*c*, and 1*d* that carry visible images (toner images) of the respective colors are arranged, respectively, and an intermediate transfer belt 8 that is driven by a driving unit (not shown) to rotate in a counterclockwise direction in FIG. 1 is provided adjacently to the image forming portions Pa to Pd. The toner images formed on the photosensitive drums 1*a* to 1*d* are sequentially primarily transferred onto the intermediate transfer belt 8, which is moving while being in contact with the photosensitive drums 1*a* to 1*d*, and are superimposed on each other. After that, by an operation of a secondary transfer roller 9, an image resulting from the superimposition is secondarily transferred onto a paper sheet P as one example of a recording medium and then, at a fixing device 13, is fixed on the paper sheet P, which then is ejected from an apparatus main body. While the photosensitive drums 1*a* to 1 *d* are being rotated in a clockwise direction in FIG. 1, an image forming process with respect to the photosensitive drums 1*a* to 1*d* is executed.

The paper sheet P onto which a toner image is to be transferred is housed in a paper sheet cassette 16 at a lower portion in the main body of the color printer 100, and is conveyed via a paper feed roller 12*a* and a registration roller pair 12*b* to a nip portion between the secondary transfer roller 9 and an after-mentioned driving roller 11 of the intermediate transfer belt 8. As the intermediate transfer belt 8, a seam-free (seamless) belt is mainly used. Furthermore, on a downstream side of the secondary transfer roller 9, there is disposed a blade-shaped belt cleaner 19 for removing toner or the like remaining on a surface of the intermediate transfer belt 8.

Next, a description is given of the image forming portions Pa to Pd. Around and below the photosensitive drums 1*a* to 1*d*, which are rotatably arranged, there are provided charging devices 2*a*, 2*b*, 2*c*, and 2*d* that charge the photosensitive drums 1*a* to 1*d*, respectively, an exposure device 5 that exposes the photosensitive drums 1*a* to 1*d* to light carrying image information, developing devices 3*a*, 3*b*, 3*c*, and 3*d* that form toner images on the photosensitive drums 1*a* to 1*d*, respectively, and cleaning devices 7*a*, 7*b*, 7*c*, and 7*d* that remove a developer (toner) or the like remaining on the photosensitive drums 1*a* to 1*d*, respectively.

Upon image data being inputted from a host apparatus such as a personal computer or the like, first, surfaces of the photosensitive drums 1*a* to 1*d* are uniformly charged by the charging devices 2*a* to 2*d*, respectively, and subsequently are irradiated by the exposure device 5 with light in accordance with image data, so that electrostatic latent images corresponding to the image data are formed on the photosensitive drums 1*a* to 1*d*, respectively. The developing devices 3*a* to 3*d* are filled with a prescribed quantity of two-component developer containing toner of the respective colors of cyan, magenta, yellow, and black, respectively. In a case where, as a result of after-mentioned toner image formation, a percentage of the toner in the two-component developer filled in the developing devices 3*a* to 3*d* falls below a set value, the developing devices 3*a* to 3*d* are replenished with toner from toner containers 4*a* to 4*d*, respectively. By the developing devices 3*a* to 3*d*, the toner in the developer is supplied onto the photosensitive drums 1*a* to 1*d*, respectively, and electrostatically adheres thereto, so that toner images corresponding to the electrostatic latent images formed through exposure by the exposure device 5 are formed thereon.

Then, by primary transfer rollers 6*a* to 6*d*, between the primary transfer rollers 6*a* to 6*d* and the photosensitive drums 1*a* to 1*d*, a prescribed transfer voltage is applied to cause the toner images of cyan, magenta, yellow, and black on the photosensitive drums 1*a* to 1*d* to be primarily transferred onto the intermediate transfer belt 8. These images of the four colors are formed in a prescribed positional relationship preset for formation of a prescribed full-color image. After that, in preparation for succeeding formation of new electrostatic latent images, toner or the like remaining on the surfaces of the photosensitive drums 1*a* to 1*d* after the primary transfer is removed by the cleaning devices 7*a* to 7*d*, respectively.

The intermediate transfer belt 8 is laid across a tension roller 10 on an upstream side and the driving roller 11 on a downstream side. When, as the driving roller 11 is driven by a driving motor (not shown) to rotate, the intermediate transfer belt 8 starts to rotate in the counterclockwise direction, at prescribed timing, the paper sheet P is conveyed from the registration roller pair 12*b* to the nip portion (a secondary transfer nip portion) between the driving roller 11 and the secondary transfer roller 9 provided adjacently thereto, at which a full-color image on the intermediate transfer belt 8 is transferred onto the paper sheet P. The paper sheet P onto which the toner images have been transferred is conveyed to the fixing device 13 by passing through a paper sheet conveyance path 18.

The paper sheet P conveyed to the fixing device 13 is heated by a fixing belt 21 and pressed by a pressing roller 23 (see FIG. 3) so that the toner images are fixed on a surface of the paper sheet P, thus forming a prescribed full-color image. A conveying direction of the paper sheet P on which the full-color image has been formed is controlled by a conveyance guide 14 that is disposed at a bifurcation portion bifurcating in a plurality of directions. In a case of forming an image on only one of both sides of the paper sheet P, by an ejection roller pair 15, the paper sheet P is directly ejected on an ejection tray 17.

Figure 2:
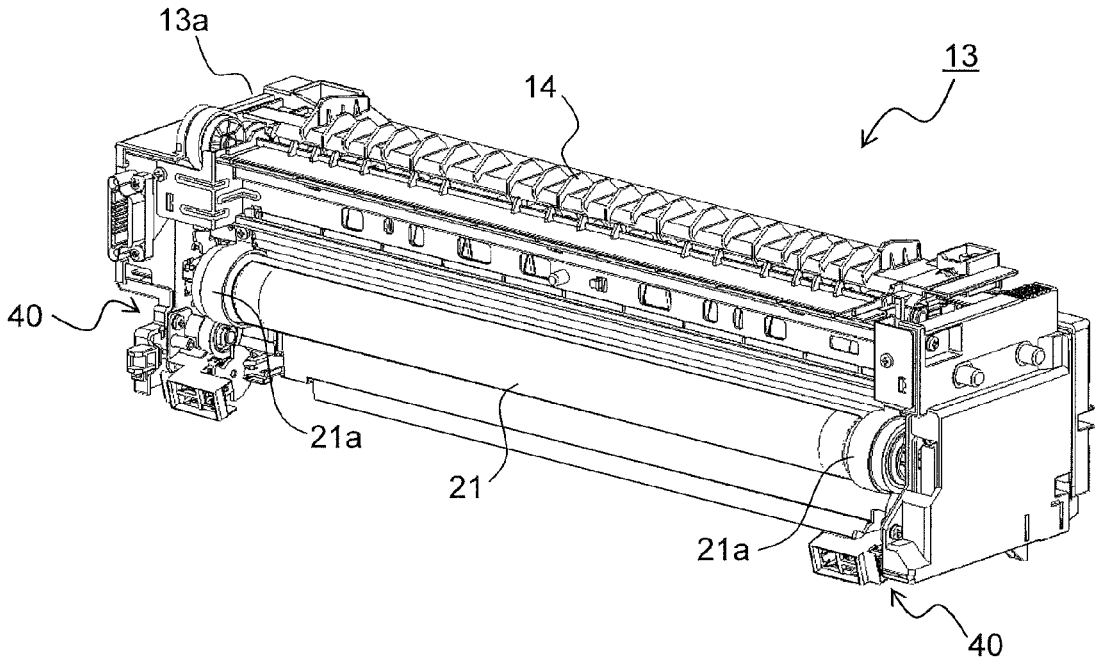
FIG. 2 is an outer appearance perspective view of the fixing device.
Figure 3:
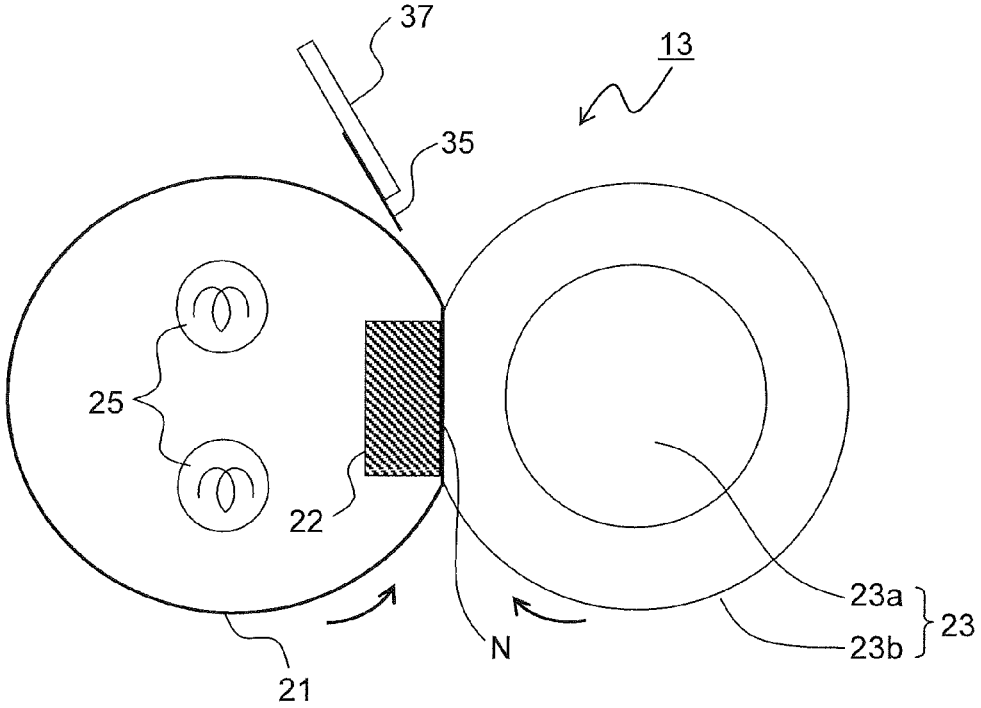
FIG. 3 is a side sectional view showing an internal structure of the fixing device.

FIG. 2 is an outer appearance perspective view of the fixing device 13 mounted in the color printer 100, and FIG. 3 is a side sectional view showing an internal structure of the fixing device 13. Constituent components common to those in FIG. 1 are denoted by the same reference characters, and descriptions thereof are omitted. The fixing device 13 is provided, in a housing 13*a*, with the endless fixing belt 21, the pressing roller 23, and a halogen heater 25 that is disposed in an inner portion of the fixing belt 21. On an upper surface of the housing 13*a*, the conveyance guide 14 that performs switching of the conveyance direction of the paper sheet P is swingably supported. In a vicinity of each of both end portions of the fixing belt 21, a rotation detection mechanism 40 that detects rotation of the fixing belt 21 is disposed. A detailed configuration of the rotation detection mechanism 40 will be described later.

By a disc-shaped flange portion 21*a* that is in contact internally with each of the both end portions of the fixing belt 21 in a width direction thereof and a holding member 22 that is in contact internally with the inner portion of the fixing belt 21 along a longitudinal direction thereof, a prescribed tension is applied to the fixing belt 21. Furthermore, a thermistor (not shown) is provided so as to be in contact with a surface of the fixing belt 21. The thermistor is used to detect a temperature of the fixing belt 21, and based on a result thereof, the halogen heater 25 is turned on/off to control a fixing temperature. Here, a surface temperature of the fixing belt 21 is set to 140° C.

Furthermore, a dimension of the fixing belt 21 in the width direction thereof (a direction perpendicular to a paper plane of FIG. 3) is set to be wider than a largest possible width of a paper sheet to be passed through a fixing nip portion N. Thus, regardless of a size of a paper sheet, the fixing belt 21 can cover an entire region of an image surface of the paper sheet, so that it is possible to prevent unfixed toner from adhering to the holding member 22 and the pressing roller 23.

The holding member 22 is in contact with the pressing roller 23 via the fixing belt 21, thereby forming the fixing nip portion N through which a paper sheet is passed. As a material of the holding member 22, for example, a heat-resistant resin such as a liquid crystal polymer or the like is used. Furthermore, in order to reduce a sliding load of a contact surface (a sliding surface) between the holding member 22 and the fixing belt 21, a fluorine resin-based coat layer such as a PTFE sheet or the like is formed thereon. An elastic layer of a silicone rubber or the like may be disposed on an inner side of the coat layer.

The pressing roller 23 is pressed into contact with the holding member 22 via the fixing belt 21 and rotates in that state in a clockwise direction in FIG. 3. For example, the pressing roller 23 is formed of a core bar 23*a* and an elastic layer 23*b* that is provided on an outer side of the core bar 23*a*. At each of both end portions of the core bar 23*a*, a pressure adjustment mechanism (not shown) is disposed that adjusts a press-contact force of the pressing roller 23 against the fixing belt 21. By an unshown driving motor, the pressing roller 23 is driven to rotate in the clockwise direction. In order to enhance mold releasability, a surface of the pressing roller 23 is coated with a PFA tube having a thickness of 50 μm.

On a downstream side of the fixing nip portion N with respect to a paper sheet conveyance direction (a down-to-up direction in FIG. 3), a separation plate 35 that separates a paper sheet from the fixing belt 21 and a separation plate holder 37 that supports the separation plate 35 are disposed.

Based on a temperature detected by the thermistor, power supply from a power source is controlled so that the fixing belt 21 is heated to a prescribed temperature by the halogen heater 25. Further, when the fixing belt 21 is heated and thus a temperature thereof has risen to a prescribed temperature, a paper sheet held in a sandwiched manner by the fixing nip portion N is heated and also pressed by the pressing roller 23, so that toner in a powder state on the paper sheet is fused to be fixed.

Figure 4:
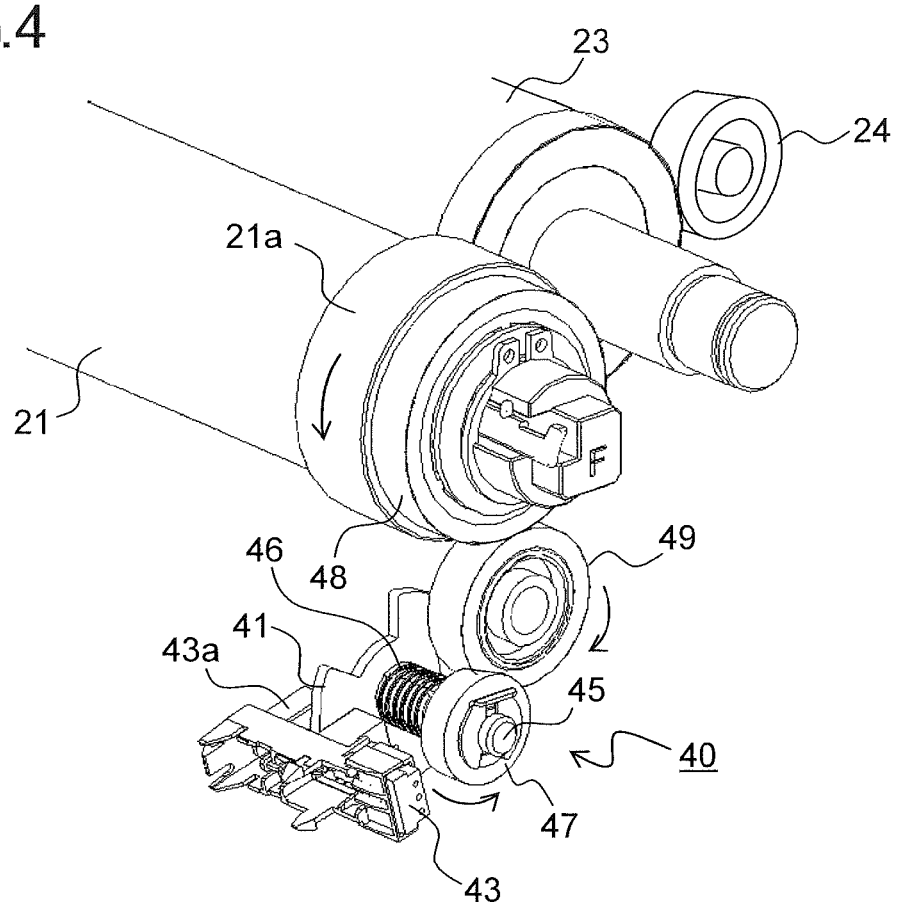
FIG. 4 is a perspective view of a periphery of one end portion of the fixing device, at which a rotation detection mechanism according to one embodiment of the present disclosure is provided.
Figure 5:
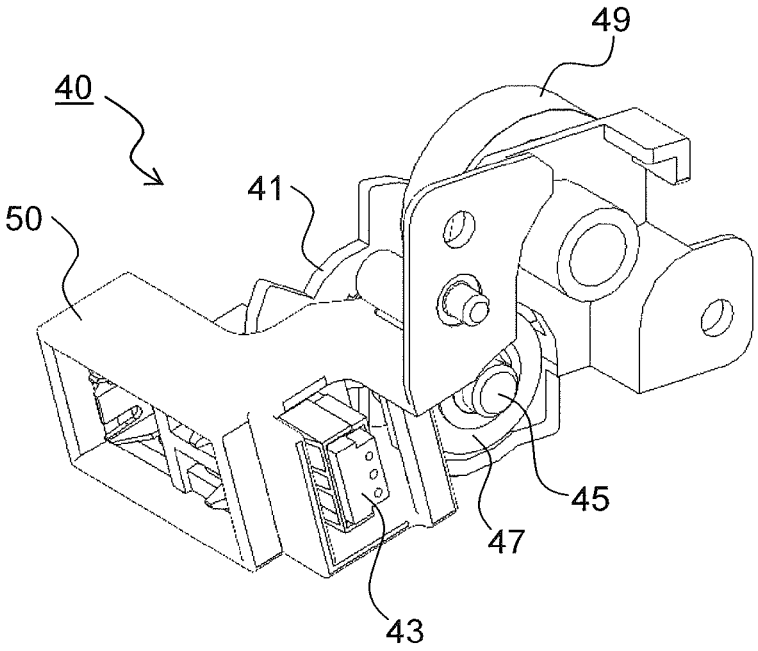
FIG. 5 is a perspective view of the rotation detection mechanism of this embodiment.
Figure 6:
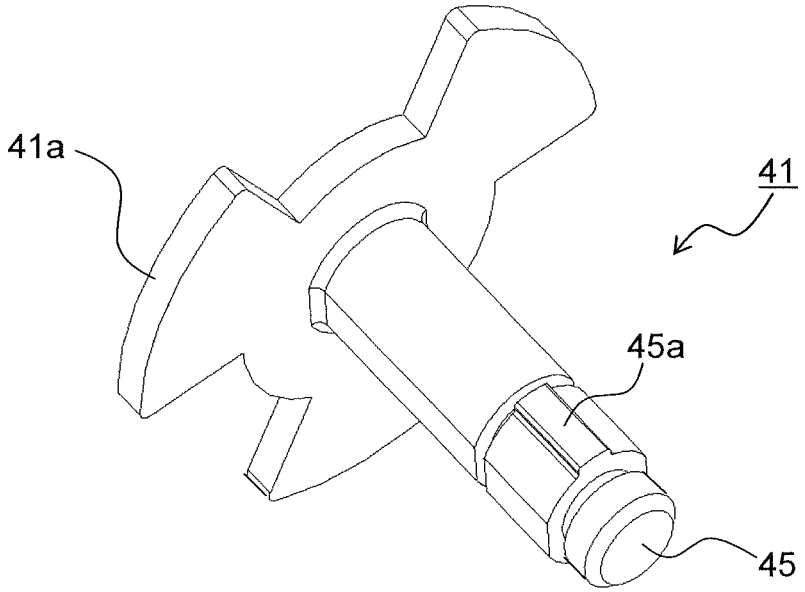
FIG. 6 is an outer appearance perspective view of a pulse plate and a rotary shaft that are components of the rotation detection mechanism of this embodiment.
Figure 7:
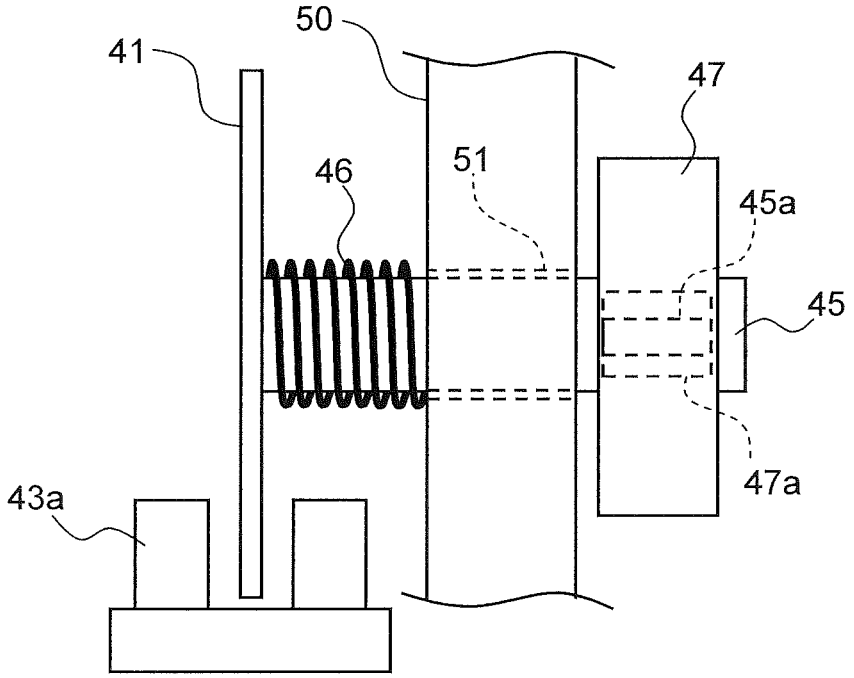
FIG. 7 is a plan view, as seen from above in FIG. 5, of a periphery of the rotary shaft of the rotation detection mechanism.

FIG. 4 is a perspective view of a periphery of one end portion (a right end portion in FIG. 2) of the fixing device 13 in which a rotation detection mechanism 40 according to one embodiment of the present disclosure is provided, FIG. 5 is a perspective view of the rotation detection mechanism 40 of this embodiment, FIG. 6 is an outer appearance perspective view of a pulse plate 41 and a rotary shaft 45 that are components of the rotation detection mechanism 40, and FIG. 7 is a plan view, as seen from above in FIG. 5, of a periphery of the rotary shaft 45 of the rotation detection mechanism 40. In FIG. 4, depictions of the housing 13*a* and a holder 50 are omitted.

As shown in FIG. 4, the rotation detection mechanism 40 has the pulse plate 41 and a rotation detection sensor 43 that is disposed opposite to the pulse plate 41. On an outer peripheral surface of the pulse plate 41, a plurality of light-blocking portions 41*a* (see FIG. 6) that perform switching between on and off states of the rotation detection sensor 43 are formed so as to be spaced at an equal distance from each other. The rotary shaft 45 is secured to a rotation center of the pulse plate 41, and an input gear 47 is additionally provided to a tip end of the rotary shaft 45.

The rotation detection sensor 43 is a PI (photointerrupter) sensor of a U shape in plan view, and on opposed inner surfaces thereof, a detection portion 43*a* composed of a light-emitting portion and a light-receiving portion is provided. As the pulse plate 41 rotates, the light-blocking portions 41*a* interrupt and open an optical path of the detection portion 43*a*, causing a light-receiving signal level of the detection portion 43*a* to switch from high to low and from low to high, and thus rotation of the fixing belt 21 can be detected.

A large-diameter gear 48 is formed at the flange portion 21*a* secured to each of the both end portions of the fixing belt 21, and an idle gear 49 is disposed that engages with the input gear 47 and the large-diameter gear 48. The rotary shaft 45 of the pulse plate 41, together with the rotation detection sensor 43 and the idle gear 49, is supported to the holder 50.

The pulse plate 41 is made of resin, and as shown in FIG. 6, on an outer peripheral edge thereof, the light-blocking portions 41*a* are formed so as to be spaced at an equal distance from each other. At the rotation center of the pulse plate 41, the rotary shaft 45 is formed integrally with the pulse plate 41. The rotary shaft 45 is formed in an oval shape in cross section, which is intended to avoid a parting line being formed at the time of molding the rotary shaft 45 by using a mold. On an outer peripheral surface of the rotary shaft 45, a convex portion 45*a* is formed that protrudes along an axial direction of the rotary shaft 45, so that the rotary shaft 45 is in a key shape when seen from the axial direction.

As shown in FIG. 7, in the input gear 47 additionally provided at the tip end of the rotary shaft 45, there is formed an engagement groove 47*a* with which the convex portion 45*a* engages. The engagement groove 47*a* is formed so as to be larger than the convex portion 45*a* in a circumferential direction of the input gear 47, so that the input gear 47 engages with the rotary shaft 45, with prescribed play (rotational backlash) provided therebetween. Furthermore, a compression spring 46 is externally inserted around the rotary shaft 45. The compression spring 46 is provided in a sandwiched manner between the pulse plate 41 and the holder 50 and applies a prescribed rotational load to the pulse plate 41.

Next, a detailed description is given of an operation of the rotation detection mechanism 40. When a driving force from a driving device (not shown) is transferred via a driving input gear 24 (see FIG. 4) to drive the pressing roller 23 to rotate, and the fixing belt 21 starts to rotate following rotation of the pressing roller 23, the flange portion 21*a* secured to each of the both end portions of the fixing belt 21 also rotates in the same direction (a counterclockwise direction in FIG. 4) as a direction in which the fixing belt 21 rotates.

Subsequently, the idle gear 49 engaging with the large-diameter gear 48 formed at the flange portion 21*a* rotates in a clockwise direction in FIG. 4. Then, the input gear 47 engaging with the idle gear 48 rotates in the counterclockwise direction in FIG. 4.

Then, the rotary shaft 45 with which the input gear 47 engages and the pulse plate 41 secured to the rotary shaft 45 also rotate in the counterclockwise direction in FIG. 4. As the pulse plate 41 rotates, the light-blocking portions 41*a* sequentially pass through the detection portion 43*a* of the rotation detection sensor 43. Due to the passage of the light-blocking portions 41*a*, switching of a light-receiving signal level of the detection portion 43*a* occurs and is transmitted as a detection signal to a control portion (not shown), and thus rotation of the fixing belt 21 is detected. In a case where rotation of the fixing belt 21 is detected, a detection signal is transmitted to the control portion, and a control signal is transmitted from the control portion to the halogen heater 25 (see FIG. 3), so that heating of the fixing belt 21 is started.

An angle of rotational backlash between the rotary shaft 45 and the input gear 47 is set to be larger than a rotation angle of the pulse plate 41 at the time of occurrence of tooth skipping of the driving input gear 24 that inputs a rotational driving force to the pressing roller 23, and thus a driving force transferred to the pulse plate 41 at the time of occurrence of tooth skipping can be absorbed by the rotational backlash. Furthermore, a rotational load of the compression spring 46 can prevent the pulse plate 41 from inversely rotating due to an inertial force exerted when the pulse plate 41 stops to rotate.

Figure 8:
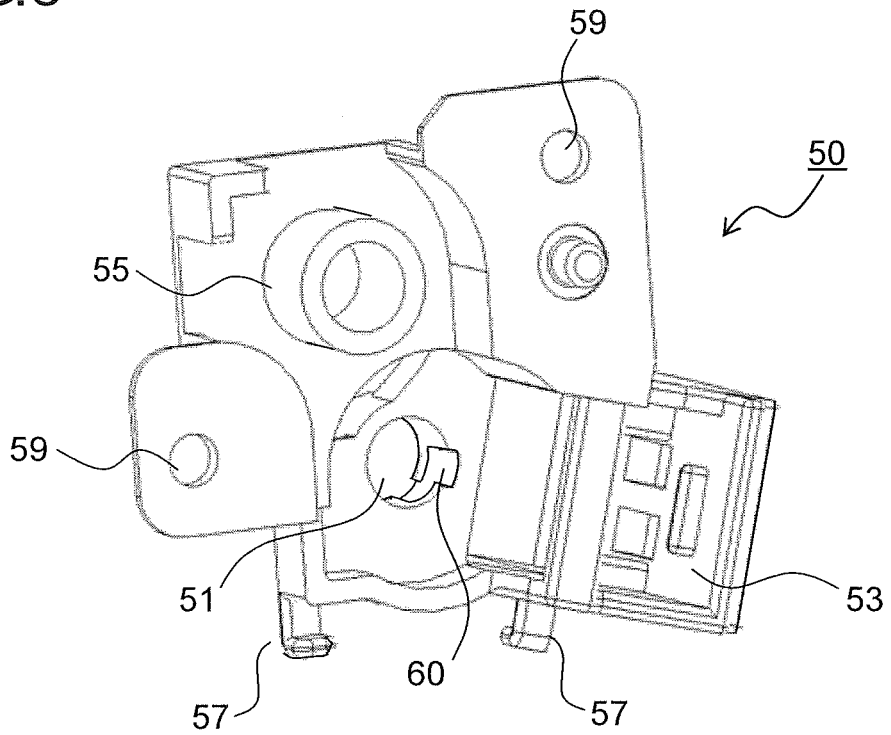
FIG. 8 is a perspective view, as seen from an inner side, of a holder that is a component of the rotation detection mechanism of this embodiment.
Figure 9:
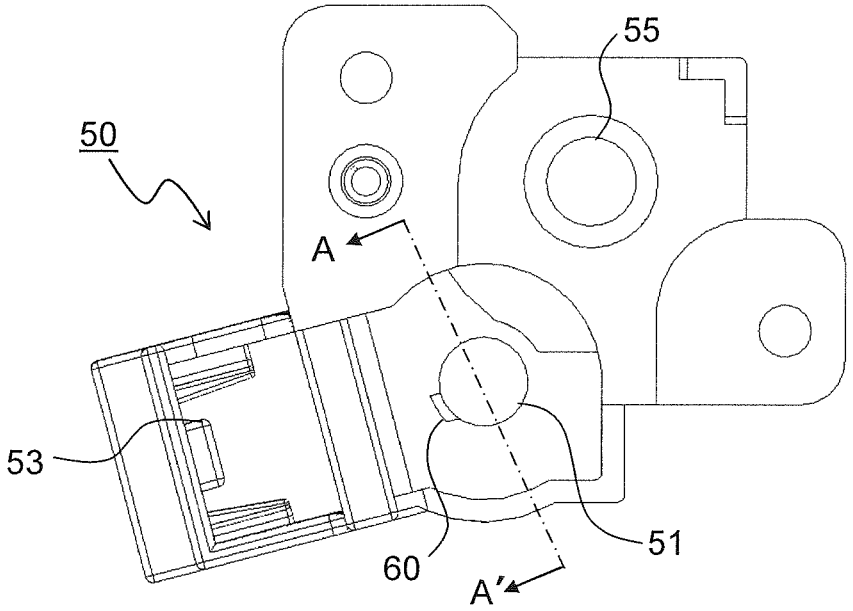
FIG. 9 is a side view of the holder as seen from outside.
Figure 10:
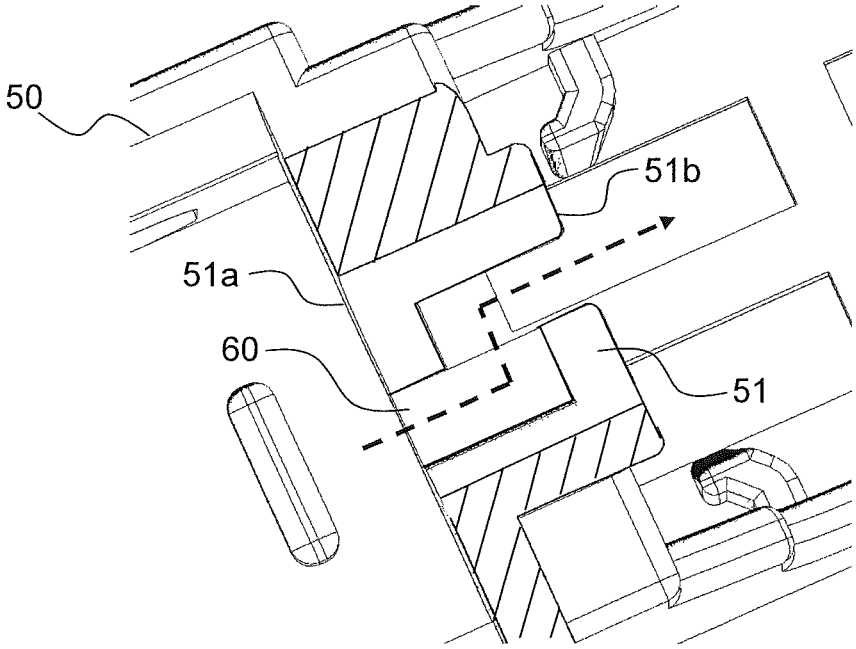
FIG. 10 is a sectional view of the holder as cut along an axial direction of a bearing hole.

FIG. 8 is a perspective view, as seen from an inner side (a rotation detection sensor 43 side), of the holder 50 that holds the pulse plate 41, FIG. 9 is a side view of the holder 50 as seen from outside, and FIG. 10 is a sectional view (a sectional view as seen in a direction of arrows A and A' in FIG. 9) of the holder 50 as cut in an axial direction of a bearing hole 51. FIG. 8 to FIG. 10 show one of the holders 50 that is disposed on the other end side (a left back side in FIG. 2) of the fixing device 13 and thus is symmetrical in shape to the other one of the holders 50 that is shown in FIG. 5.

The holder 50 is made of resin and, as shown in FIG. 8, has the bearing hole 51 that rotatably supports the rotary shaft 45 of the pulse plate 41, a sensor holding portion 53 that holds the rotation detection sensor 43, a boss portion 55 that rotatably supports the idle gear 49, and an engagement lug 57 and a screw hole 59 for securing the holder 50 to the housing 13*a*.

On an inner peripheral surface of the bearing hole 51, there is formed a groove portion 60 for inserting the key-shaped rotary shaft 45 thereinto. As shown in FIG. 10, the groove portion 60 is bent in a crank shape across a length from an inner side end edge 51*a* to an outer side end edge 51*b* of the bearing hole 51.

In inserting the rotary shaft 45 into the bearing hole 51, the convex portion 45*a* of the rotary shaft 45 is aligned with an opening of the groove portion 60 on an inner side end edge 51*a* side. As the rotary shaft 45 is inserted in this state into the bearing hole 51, the convex portion 45*a* bumps into a bent portion of the groove portion 60. Next, the rotary shaft 45 is rotated in a bending direction of the groove portion 60 so that the rotary shaft 45, while being slid along a bent shape of the groove portion 60 as shown by a broken line in FIG. 10, penetrates to the outer side end edge 51*b*. When the rotary shaft 45 has penetrated the bearing hole 51, the pulse plate 41 is disposed between the light-emitting portion and the light-receiving portion of the detection portion 43*a*.

Figure 11:
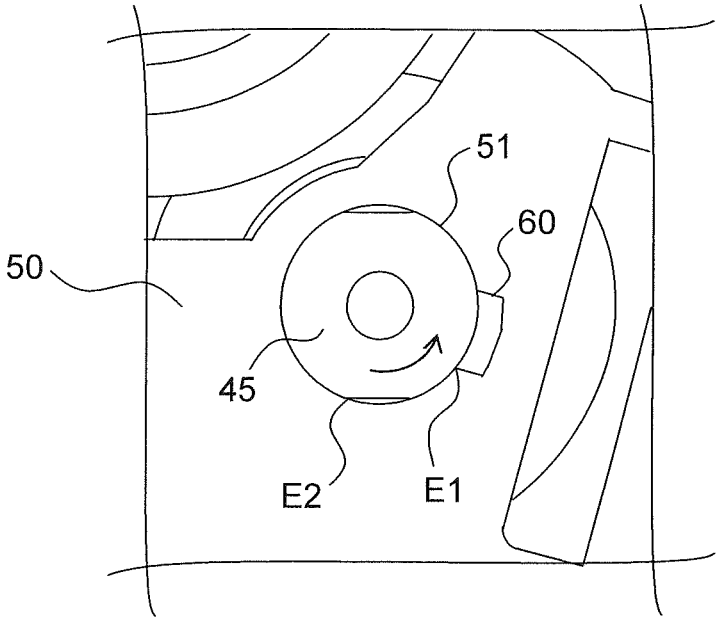
FIG. 11 is a side view of a rotary shaft of a pulse plate and a bearing hole of a holder, which holds the rotary shaft, in a conventional rotation detection mechanism.

In a configuration of this embodiment, an edge of the groove portion 60 is not continuous in the axial direction from the inner side end edge 51*a* to the outer side end edge 51*b* of the bearing hole 51. In other words, when the bearing hole 51 is seen from the axial direction as shown in FIG. 9, the bearing hole 51 is not in a key shape but in a circular shape having no omitted portion on an inner peripheral surface thereof. Thus, compared with a conventional configuration (see FIG. 11) in which an edge of a groove portion 60 is continuous in an axial direction thereof, it becomes unlikely that the outer peripheral surface of the rotary shaft 45 is caught by the edge of the groove portion 60, and thus a sliding load of the rotary shaft 45 is reduced. Accordingly, the pulse plate 41 can be rotated smoothly, and thus it is possible to effectively suppress occurrence of a rotation detection failure due to rotation irregularities of the pulse plate 41. Furthermore, this configuration is effective also in reducing abrasion and abnormal noise caused by sliding between the rotary shaft 45 and the bearing hole 51.

Furthermore, the convex portion 45*a* is inserted while being slid along a shape of the groove portion 60, and thus the rotary shaft 45 can be easily inserted into the bearing hole 51. Accordingly, there is no fear that workability in assembling the rotation detection mechanism 40 might be decreased.

Other than the above, the present disclosure is not limited to the above-described embodiment, and various modifications thereto are possible without departing from the spirit of the present disclosure. For example, while the above-described embodiment uses, as an example, the fixing device 13 of the belt heating system, which is provided with the endless fixing belt 21 as a rotary body to be heated, to describe the rotation detection mechanism 40 that detects rotation of the fixing belt 21, needless to say, the present disclosure is applicable in an exactly similar manner to a fixing device provided with a rotary body to be heated other than the fixing belt 21. Furthermore, the heating unit is also not limited to the halogen heater 25, and an induction heating method provided with an excitation coil and a core can also be adopted.

For example, in a case of the roller heating system in which a fixing roller is provided as a rotary body to be heated, and an unfixed toner image is fixed on a recording medium at a nip between the fixing roller and a pressing roller, the present disclosure can be used as a rotation detection mechanism for a fixing roller. Furthermore, the present disclosure can also be used as a rotation detection mechanism for a rotary body other than a fixing belt or a fixing roller, such as, for example, the photosensitive drums 1*a* to 1 *d* or the like.

Furthermore, the present disclosure is not limited to the tandem type color printer 100 shown in FIG. 1 and is applicable to various types of image forming apparatuses each provided with a fixing device, such as a monochrome copy machine, a digital multi-functional peripheral, a facsimile, a laser printer, or the like.

The present disclosure is applicable to a rotation detection mechanism that is provided with a pulse plate and a rotation detection sensor and detects rotation of a rotary body to be heated such as a fixing belt, a fixing roller, or the like. The use of the present disclosure reduces a sliding load between a pulse plate having a key-shaped rotary shaft and a holder into which the key-shaped rotary shaft can be inserted, thereby providing a rotation detection mechanism that can prevent occurrence of a rotation detection failure.

What is claimed is:

1. A rotation detection mechanism, comprising:

a pulse plate that has a light-blocking portion formed on an outer peripheral surface thereof;

an optical sensor that has a detection portion that detects whether an optical path thereof is opened or interrupted by the light-blocking portion of the pulse plate;

a holder that has a bearing hole that rotatably supports a rotary shaft of the pulse plate; and an input gear that inputs a rotational driving force to the rotary shaft, wherein the rotary shaft has a convex portion formed on an outer peripheral surface thereof and thus is in a key shape when seen from an axial direction thereof, and on an inner peripheral surface of the bearing hole, a groove portion is formed through which the convex portion passes when the rotary shaft is inserted into the bearing hole, and the bearing hole is in a circular shape when seen from an axial direction thereof.

2. The rotation detection mechanism according to claim 1, wherein the groove portion is formed so as to be bent in a crank shape across a length from one end edge to an other end edge of the bearing hole.

3. The rotation detection mechanism according to claim 1, wherein the rotary shaft is made of resin and formed by molding in an oval shape in cross section.

4. The rotation detection mechanism according to claim 1, wherein in the input gear, an engagement groove is formed with which the convex portion engages, and in a circumferential direction of the input gear, the engagement groove has a dimension larger than that of the convex portion, so that the input gear engages with the rotary shaft, with prescribed rotational backlash provided therebetween.

5. A fixing device, comprising:

the rotation detection mechanism according to claim 4;

a rotary body to be heated that is heated by a heating unit; and a pressing member that is pressed into contact with the rotary body to be heated, thus forming a fixing nip portion, wherein the rotation detection mechanism detects whether or not the rotary body to be heated is rotating, a recording medium onto which a toner image has been transferred is passed through the fixing nip portion so that the toner image that has been transferred onto the recording medium is fixed, and an angle of rotational backlash between the rotary shaft and the input gear is larger than a rotation angle of the pulse plate at a time of occurrence of tooth skipping of a driving input gear that inputs a rotational driving force to the rotary body to be heated.

6. A fixing device, comprising:

the rotation detection mechanism according to claim 1;

a rotary body to be heated that is heated by a heating unit; and a pressing member that is pressed into contact with the rotary body to be heated, thus forming a fixing nip portion, wherein the rotation detection mechanism detects whether or not the rotary body to be heated is rotating, and a recording medium onto which a toner image has been transferred is passed through the fixing nip portion so that the toner image that has been transferred onto the recording medium is fixed.

7. An image forming apparatus comprising the fixing device according to claim 6.

* * * * *